United States Patent [19]

Nagase et al.

[11] Patent Number: 4,700,261

[45] Date of Patent: Oct. 13, 1987

[54] METHOD AND APPARATUS FOR ELECTRICALLY CHARGING OR DISCHARGING

[75] Inventors: Yukio Nagase, Tokyo; Hidemi Egami, Zama; Tatsuo Takeuchi, Kawasaki; Hiroshi Satomura, Hatogaya, all of Japan

[73] Assignee: Canon Kabushiki Kaisha, Tokyo, Japan

[21] Appl. No.: 941,078

[22] Filed: Dec. 12, 1986

[30] Foreign Application Priority Data

Dec. 14, 1985 [JP] Japan ..... 60-281494

[51] Int. Cl.[4] ..... H01T 19/00; G03G 15/02

[52] U.S. Cl. ..... 361/225; 361/230; 355/3 CH; 250/326

[58] Field of Search ..... 361/214, 225, 229, 230, 361/235; 250/324–326; 355/3 CH

[56] References Cited

U.S. PATENT DOCUMENTS 4,155,093 5/1979 Fotland et al. ..... 361/229 X

FOREIGN PATENT DOCUMENTS 195566 10/1985 Japan ..... 355/3 CH 2156597 10/1985 United Kingdom ..... 355/3 CH

*Primary Examiner*—L. T. Hix

*Assistant Examiner*—D. Rutledge

*Attorney, Agent, or Firm*—Fitzpatrick, Cella, Harper & Scinto

[57] ABSTRACT

A discharging device includes first and second electrodes sandwiching therebetween a dielectric member, wherein an alternating voltage is applied between the first electrode and the second electrode to produce electric discharge adjacent to the second electrode. The relation between the alternating voltage and a distance between an end surface of the second electrode to a corresponding end of a region where the electric discharge occurs, is so determined that an intermediate saturation property is exhibited. The level of the alternating voltage is set to provide the intermediate saturation property. With such a discharging device, a member is electrically charged or discharged.

16 Claims, 15 Drawing Figures

METHOD AND APPARATUS FOR ELECTRICALLY CHARGING OR DISCHARGING

FIELD OF THE INVENTION AND RELATED ART

The present invention relates to a method and an apparatus for electrically charging or discharging a member including photosensitive material or a dielectric material, more particularly, the method and the apparatus for electrically charging or discharging an image bearing member comprised by the above material in an image forming apparatus such as an electrophotographic machine or an electrostatic recording machine or the like.

In an electrostatic recording or an electrophotographic process, a corona discharger has been widely used to electrically discharge a chargeable member or electrically charge such a chargeable member, such as a dielectric member or a photosensitive member. However, the corona discharging device involves a problem that a slight contamination of the discharging wire can result in non-uniform discharging, and therefore, the chargeable member is placed under a non-uniform discharged or charged state. Another problem with the corona discharger is that a distance between the discharging wire and a conductive shield member enclosing the discharging wire has to be greater than a certain level, and therefore, there is a limit in reducing the size of the device.

A new type discharging device has been proposed in which an alternating voltage is applied across electrodes sandwiching a dielectric member to produce positive and negative ions in an air gap between an exposed dielectric member surface at one side and a lateral end surface of the electrode at that side. The lateral end surface is perpendicular to the surface of the dielectric member. An external electric field is applied to selectively extract ions of a predetermined polarity from the produced positive and negative ions (U.S. Pat. No. 4,155,093). In this type of the device, a strong discharging action takes place, and it prevents the above one of the electrodes from being contaminated. An additional advantage is that the size of the device can be reduced as compared with the case of the corona discharger.

However, this type of the discharging device involves a problem that ozone, which is noxious, is easily produced.

SUMMARY OF THE INVENTION

The inventors have made various and extensive experiments and considerations and found that there occurs a particular relationship between the applied alternating voltage and an extension of the discharge region when the width of the discharging electrode (said one of the electrodes) is reduced relative to the thickness of the dielectric member.

The present invention is based on this new finding.

It is a principal object of the present invention to provide a method and an apparatus for discharging a chargeable member or charging a chargeable member with minimum ozone production.

It is another object of the present invention to provide a method and an apparatus for discharging a chargeable member or for charging a chargeable member, in which the produced ions are efficiently used.

It is a further object of the present invention to provide a method and an apparatus for discharging a chargeable member or for charging a chargeable member, which can perform the discharging or charging operation uniformly, without non-uniform discharging and with a stabilized operation.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
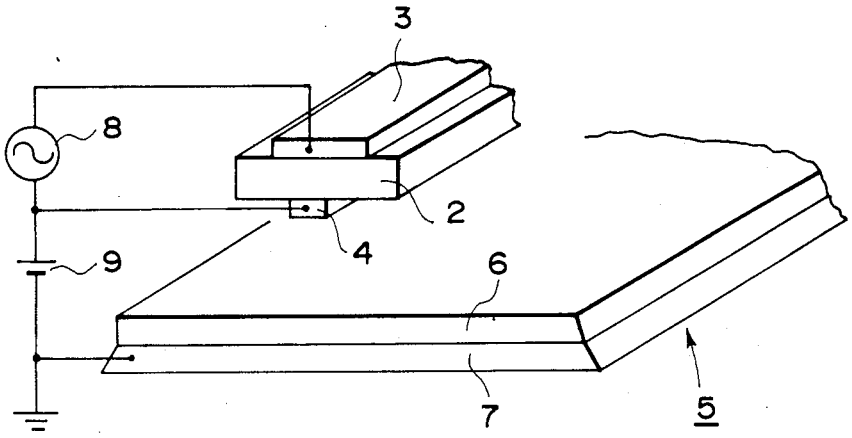
FIG. 1 is a perspective view of a discharging device embodying the discharging method according to an embodiment of the present invention.

Referring now to FIG. 1, there is shown a discharging device according to an embodiment of the present invention. The discharging device is usable in the case where a chargeable member is electrically charged or in the case where a chargeable member which has been charged is electrically discharged. For the sake of simplicity of explanation, the following description will be made with respect only to the case of the chargeable member being electrically charged.

The discharging device 1 comprises a dielectric member 2, an inducing electrode 3 and a discharging electrode 4. The dielectric member 2 is elongated and is made of dielectric material. The inducing electrode 3 and the discharging electrode 4 extend in a longitudinal direction of the elongated dielectric member 2, sandwiching the dielectric member 2. The width of the discharging electrode 4 is smaller than that of the inducing electrode 3.

The inducing electrode 3 is mounted to one side of the dielectric member (top side thereof in FIG. 1) and is made of conductive material which will be described hereinafter. The discharging electrode 4 is mounted to the other side of the dielectric member 2 (bottom surface of the dielectric member 2 in FIG. 1) and is made of conductive material which will be described hereinafter. A member 5 to be charged is opposed to the discharging electrode 4 of the discharging device 1 and includes a recording material layer 6 made of a photosensitive material or a dielectric material and a conductive base plate 7 (a back electrode).

An alternating voltage source 8 is connected to the inducing electrode 3 and the discharging electrode 4 as shown in this Figure, so as to apply an alternating voltage between the inducing electrode 3 and the discharging electrode 4. The alternating voltage is not limited to a so-called AC voltage having a symmetrical wave form with the center of 0 volt, but may be in the form of a rectangular wave, a pulse wave or asymmetrical wave.

On the other hand, a DC bias source 9 applies a DC bias voltage between the discharging electrode 4 and a conductive base plate 7 (back electrode). The bias voltage is not limited to a DC voltage, but may be in the form of an alternating voltage which is so biased as to extract the ions of a predetermined polarity.

A charging process using the discharging device will be described.

When an alternating voltage is applied between the discharging electrode 4 and the inducing electrode 3 by the alternating voltage source 8, the electric discharge action occurs in a discharge region which is in the neighborhood of the discharging electrode side surface of the dielectric member 2 adjacent to the discharging electrode 4, so that positive and negative ions are produced.

Of the positive and negative ions thus produced, the ions having the polarity determined by the polarity of the DC bias source 9 are directed to the recording material layer 6, by the DC bias voltage applied betwen the discharging electrode 4 and the conductive base plate 7. More particularly, the voltage applied by the DC bias source 9 is effective to form an electric field between the discharging electrode 4 and the chargeable member 5, which electric field has a direction depending on the direction of the voltage of the DC bias source 9. By the electric fields thus formed, the ions having the particular polarity can be extracted toward the chargeable member 5. In the example shown in FIG. 1, the electric field is directed from the discharging electrode 4 to the conductive base plate 7, so that only the positive ions are directed to the recording material layer 6, where the ions are deposited on the chargeable member 5 to electrically charge it to a positive polarity.

Figure 2:
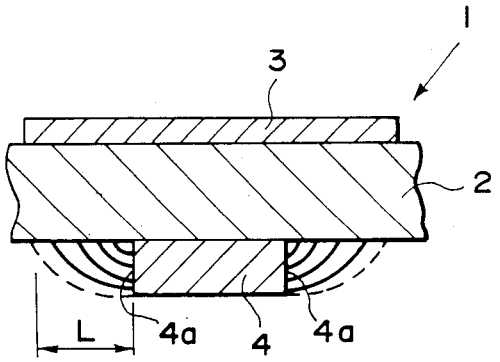
FIG. 2 is a sectional view of a discharging device illustrating an extension of the discharging region in an conventional apparatus.

Next, the description will be made with respect to an alternating voltage applied between the inducing electrode 3 and the discharging electrode 4, which is an important feature of the present invention. Various experiments and considerations made by the inventors, have revealed that, in the above described type of charging process, there is a peculiar relationship taking place between the applied alternating voltage and an extension of the discharge region, when the width of the discharging electrode 4 is decreased relative to the thickness of the dielectric member 2. Here, the extension of the discharge region is a distance L from a lateral end surface 4*a* of the discharging electrode 4 to a lateral end of the discharge region of the discharging occurring in the neighborhood of the discharging electrode 4, as shown in FIG. 2.

Figure 3:
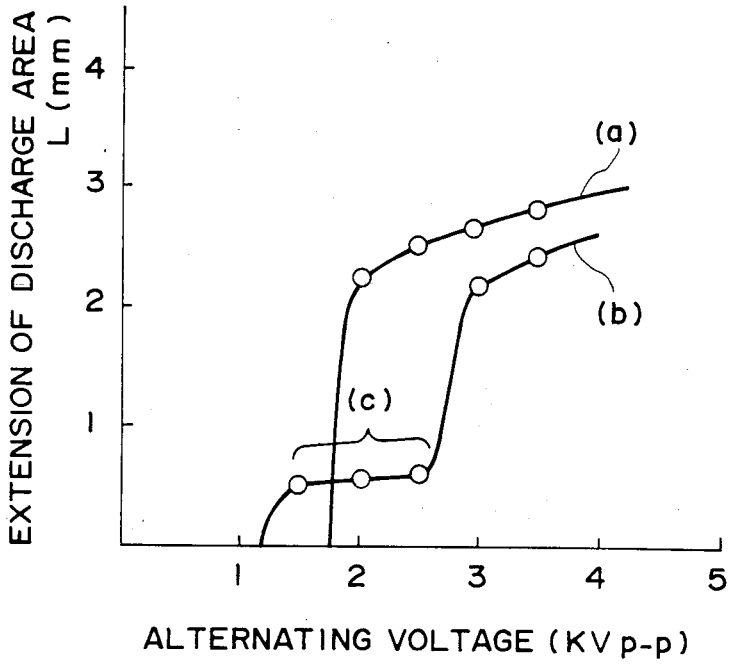
FIG. 3 is a graph representing a relationship between an alternating voltage and an extension of the discharging region in the embodiment of the present invention and in a conventional method and apparatus.

FIG. 3 illustrates this peculiar relationship, as compared with the conventional apparatus.

FIG. 3 is a graph representing the relation between the extension L of the discharge area v.s. the alternating voltage (peak-to-peak) applied between the discharging electrode 4 and inducing electrode 3. In the conventional device, as shown by the curve (a), the extension L of the discharge area increases generally linearly with the increase of the voltage from the on-set voltage. In contrast, in the present invention, the extension L of the discharge area, as shown by the curve (b), firstly increases generally linearly with the increase of the alternating voltage from the on-set voltage, and then is saturated, and thereafter again monotonously increases with the increase of the alternating voltage. In the intermediate saturated region (c), the extension of the discharge area is substantially constant even if the alternating voltage is increased. In this application, this property is called here "an intermediate saturation property", and the alternating voltage in the region exhibiting this intermediate saturation property is called "an intermediate saturation voltage". One of the feature of this invention is in that the intermediate saturation voltage is applied between the inducing electrode 3 and the discharging electrode 4.

Figure 4:
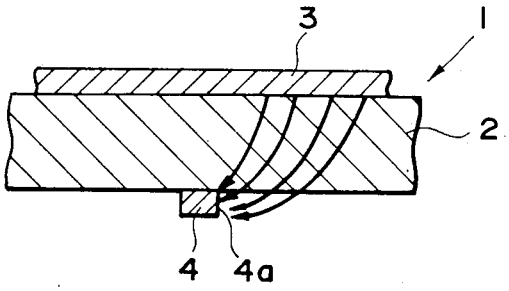
FIG. 4 is a sectional view of a discharging apparatus illustrating the electric field in an embodiment of the present invention.
Figure 5:
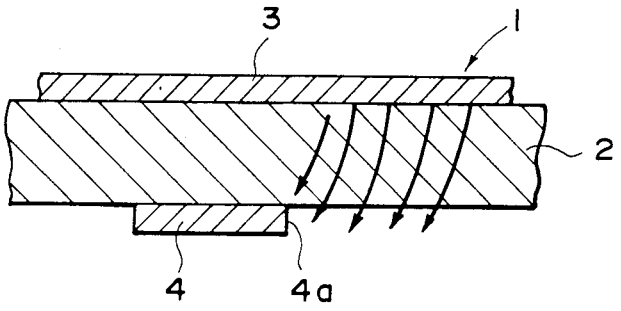
FIG. 5 is a sectional view of a conventional discharging device illustrating the electric field.

FIGS. 4 and 5 are to explain the cause of this property. The explanation of this cause is concluded as a result of various considerations by the inventors.

Generally speaking, an electric field is divided into two electric fields, one of which is uniform and the other of which is non-uniform. The uniform electric field is the electric field which is uniformly formed as with an internal electric field formed between electrode plates as in a capacitor. The non-uniform electric field is the one in which the electric field in the neighborhood of an electrode is not uniform, partly strong and partly weak.

In the present invention, the width of the discharging electrode is so small as compared with the thickness of the dielectric member 2, the discharging electrode 4 can be deemed as a linear column having a small diameter, in other words, an apparent curvature of radius of the discharging electrode 4 is a significantly large.

For this reason, the electric field is significantly concentrated to the neighborhood of the discharging electrode 4, as shown in FIG. 4, whereby a non-uniform electric field is formed. Therefore, the occurrence of the discharging is concentrated on the region which is closely adjacent to the discharging electrode 4, and the electric field is weakened at a high rate of decrease with the distance from the discharging electrode 4, so that the discharging is also weakened at a high rate of decrease with the distance from the lateral end surface 4a of the discharging electrode 4. This is considered as being a cause of the occurrence of the intermediate saturation voltage. In the conventional devices, on the contrary, the apparent curvature of radius of the discharging electrode 4 is small with the result that the significantly non-uniform electric field is produced only adjacent to the discharging electrode and that a fairly strong electric field is formed adjacent the lateral end surface 4a of the discharging electrode 4 and is gradually, at a low rate of decrease, weakened with the distance from the lateral end surface 4a. Therefore, as shown in FIG. 5, there is no locally concentrated discharging, and therefore, the extension of the discharge area in general linearly increases with the increase of the alternating voltage from the on-set voltage.

The electric field has been described with FIGS. 4 and 5, referring to only one lateral side of the discharging electrode 4. It should be understood, however, that the same thing applies to the other lateral end surface of the discharging electrode 4.

As will be understood from the foregoing, according to the present invention, the extension of the discharge region can be confined, so that the amount of ion generation can be reduced.

Figure 6:
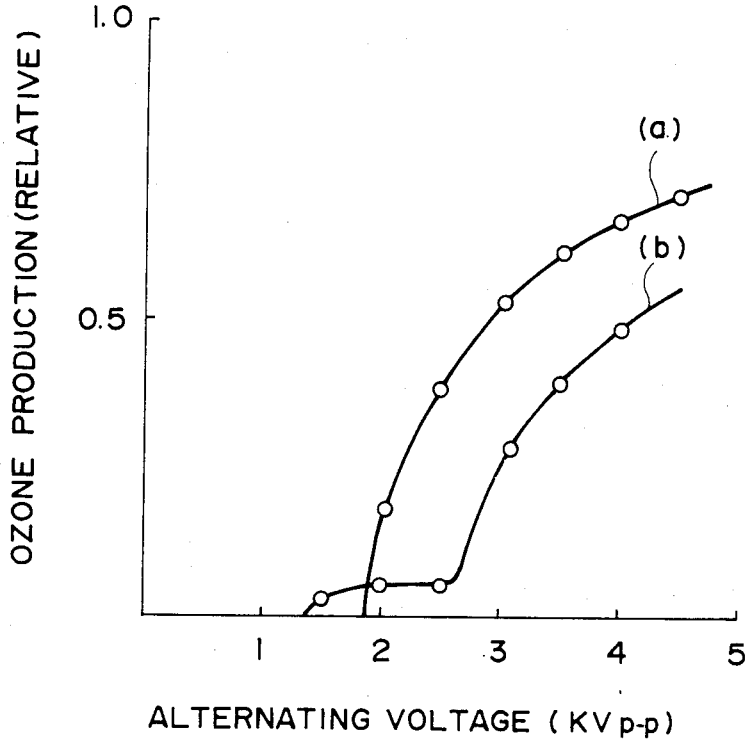
FIG. 6 is a graph illustrating the relationship between the alternating voltage and ozone production in an embodiment of the present invention and in the conventional device.

FIG. 6 represents ozone content in the ambient adjacent the discharging electrode 4, as compared with the case of the conventional device. The measurements are obtained by continuously sampling a predetermined amount of the air in the neighborhood of the discharging electrode 4. FIG. 6 represents the amount of ozone in a relative scale v.s. an alternating voltage (peak-to-peak) applied between the inducing electrode 3 and the discharging electrode 4. As will be understood from this graph, the ozone content in this embodiment (b) is approximately ⅓–1/10 of the conventional (a).

It has been confirmed that the charging or discharging effect does not decrease despite the decrease of the discharge area. This is due to the fact that the discharging between the surface of the dielectric member and the discharging electrode is mostly consumed as the discharging current. Only the discharge very close to the discharging electrode is extracted by the DC bias applied from the DC bias source 9 to the discharging electrode 4 and is effective to be ion current for the charging or discharging. Therefore, the produced ions are efficiently used.

Then, the explanation will be made as to the conditions under which the intermediate saturation property occurs. The conditions are concerned with the thickness of the dielectric member 2, the dielectric constant, the width and thickness of the discharging electrode 4, the ambient temperature and moisture. Among those factors, the thickness of the dielectric member 2 and the width of the discharging electrode are most important.

Figure 7:
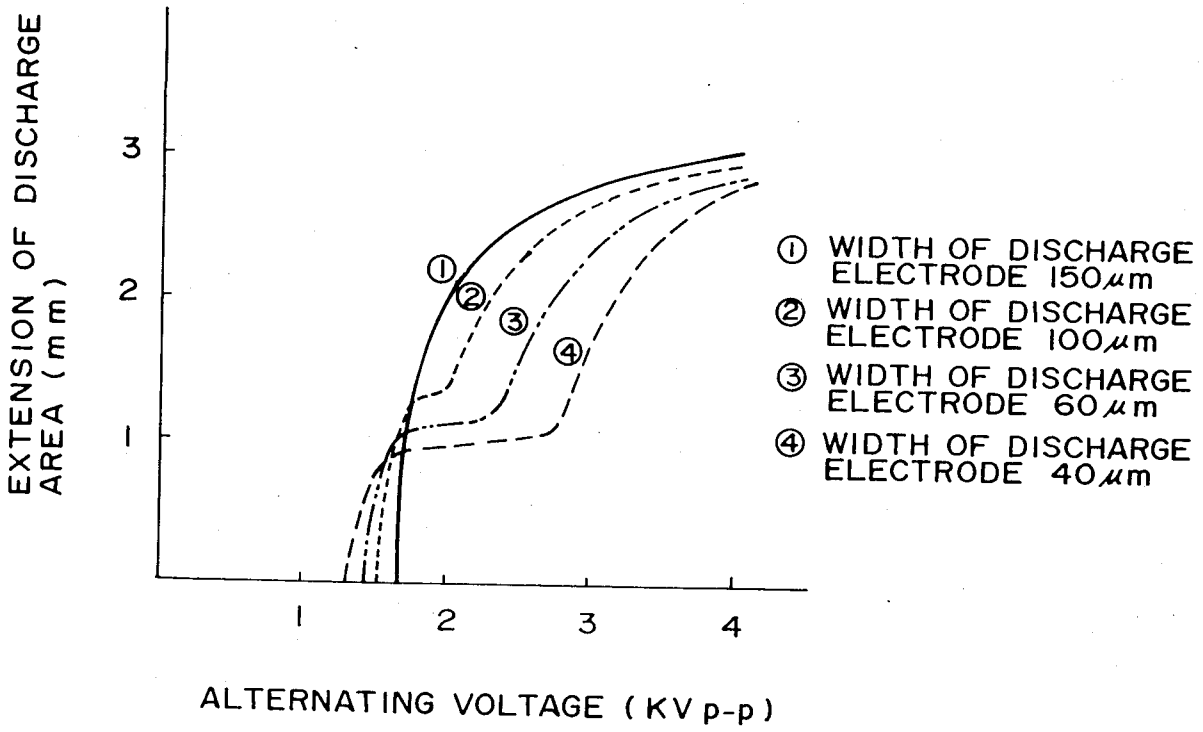
FIG. 7 is a graph representing the relationship between the alternating voltage and the extension of the discharging region under the condition that the thickness of the dielectric member is constant.

FIG. 7 is a graph representing the relation between the extension of the discharge region and the alternating voltage in an example of the device, when the width of the discharging electrode 4 is changed without changing the thickness of the dielectric member 2. When the thickness of the dielectric member is constant, the alternating voltage at which the intermediate saturation property starts to decrease with the decrease of the width of the discharging electrode 4, and the width of the intermediate saturation voltage increases with decrease of the width of the discharging electrode 4.

Figure 8:
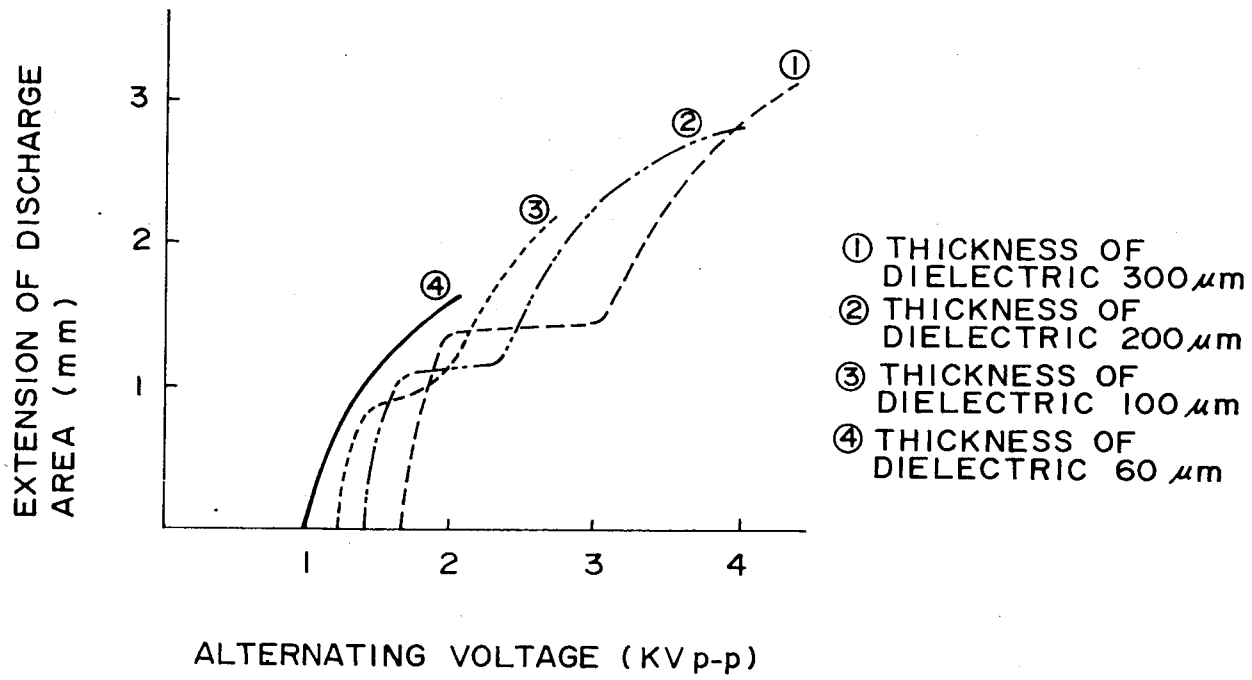
FIG. 8 is a graph representing a relationship between the alternating voltage and the extension of the discharge region under the condition that the width of the discharging electrode is constant.

FIG. 8 represents the relationship between the extension of the discharge region and the alternating voltage when the thickness of the dielectric member 2 is changed without changing the width of the discharging electrode 4. When the width of the discharging electrode 4 is constant, the intermediate saturation property appears by increasing the thickness of the dielectric member 2, and the alternating voltage at which the intermediate saturation property starts to decrease with decrease of the thickness of the dielectric member 2. The width of the intermediate saturation voltage region increases with increase of the thickness of the dielectric member 2.

Therefore, it has been found that the intermediate saturation property can be provided by decreasing the width of the discharging electrode 4 with respect to the thickness of the dielectric member 2.

The data of FIGS. 7 and 8 are obtained under the following conditions: material of the dielectric member 2, $Al_2O_3$: the dielectric constant thereof, 8–10: material of the inducing electrode 3, Cr: material of the discharging electrode 4, Ti: the thickness thereof, 0.5 microns: the ambient temperature and moisture, 15°–30° C., 40–60%: the surface of the dielectric member is heated up to approximately 40°–80 ° C. by an external heating means.

Figure 9:
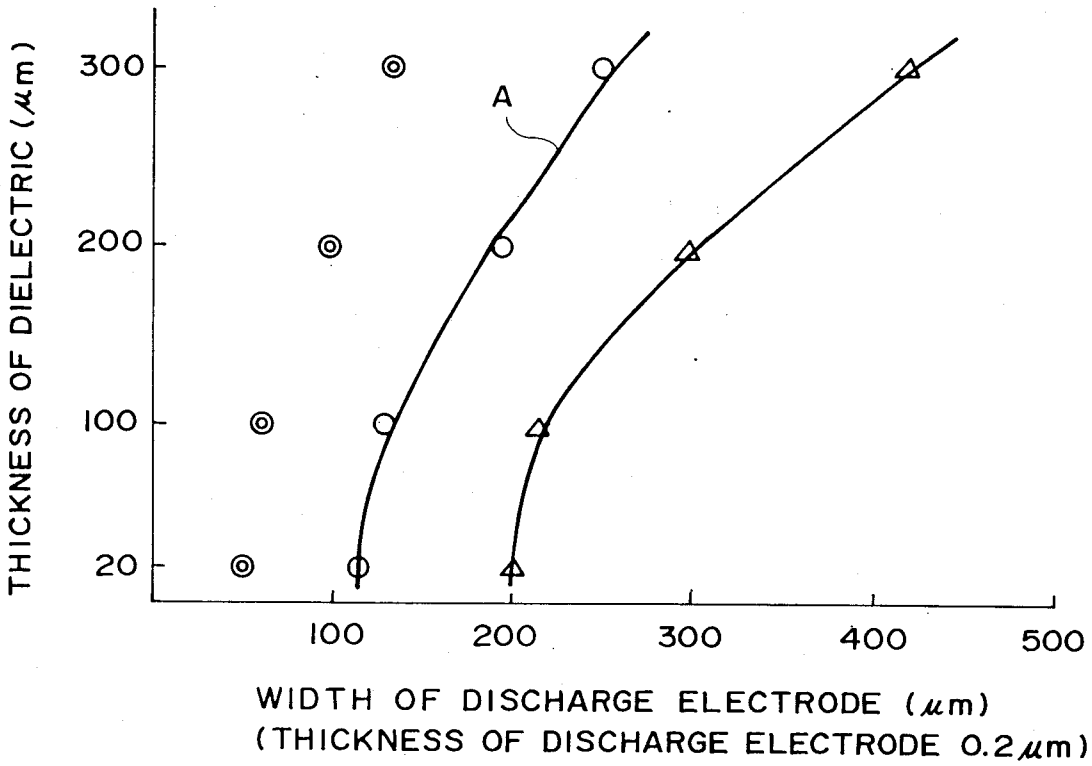
FIGS. 9 and 10 are graphs representing the relationship between the thickness of the dielectric member and the width of the discharging electrode in order to produce an intermediate saturation property on which the present invention is based.
Figure 10:
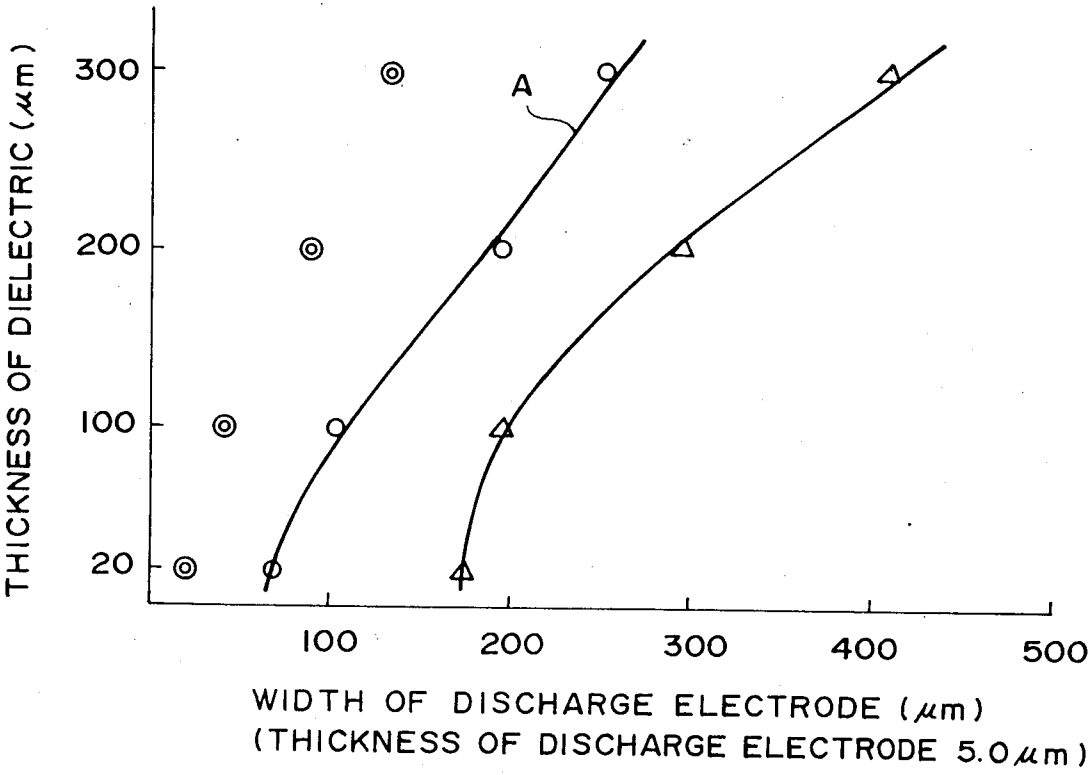

FIGS. 9 and 10 illustrate the relationship between the thickness of the dielectric member and the width of the discharging electrode for causing the internal saturation property. FIG. 9 is for the discharging electrode having the thickness of 0.2 microns, and FIG. 10 is for the discharging electrode having the thickness of 5.0 microns. The width of the discharging electrode 4 has been charged with respect to various thicknesses of the dielectric member (20 microns, 100 microns, 200 microns, 300 microns, for example). With those various parameters, the graphs represent the regions of the intermediate saturation property occurrence. The material of the dielectric member is $Al_2O_3$; the dielectric constant thereof is 8–10; material of the inducing electrode is Cr; the thickness thereof is 0.5 micron; and material of the discharging electrode is Ti.

In FIGS. 9 and 10, "Δ" represents the points of the start of the electric field concentration to the vicinity of the discharging electrode as shown in FIG. 4, which is the initial condition for the occurrence of the intermediate saturation property. In other words, the intermediate saturation property of the present invention starts to occur by reducing the width of the discharging electrode beyond those points.

In those Figures, "○" represents the points where approximately 100 volts of the width of the intermediate saturation voltage (FIGS. 7 and 8) starts, and practically it is preferable that the width of the discharging electrode is smaller than those points.

Further, "◎" represents the points where the width of the intermediate saturation voltage is more than 300 volt, and therefore, very stable intermediate saturation property is observed from practically standpoint.

Accordingly, it is preferable that the thickness of the dielectric member and the width of the discharging electrode are selected from the region which is leftward from a line A in FIGS. 9 and 10, particularly from the practical standpoint.

As will be understood from comparison of FIGS. 9 and 10, increase of the discharging electrode thickness results in decrease of the width of the intermediate saturation voltage, and this tendency is more remarkable when the thickness of the dielectric member is small (not more than 100 microns for example), and therefore, it is understood that the thickness of the discharging electrode is preferably as small as possible in order to provide a wider intermediate saturation voltage range. Taking, for instance, the case where the thickness of the dielectric member is 20 microns, the very stable intermediate saturation property as indicated by "◎" is difficult to observe, if the thickness of the discharging electrode is 10 microns.

Therefore, not more than 10 microns, more preferably 5 microns of the thickness of the discharging electrode is one of preferable conditions to obtain the stabilized intermediate saturation property, respective of the thickness of the dielectric member.

As described above, in the present invention, the intermediate saturation voltage is applied so as to produce the intermediate saturation property. For the purpose of stabilized operation of the device, it is desirable that the width of the intermediate saturation voltage range is not less than 100 volts, more preferably, not less than 200 volts by suitably determining the width of the discharging electrode 4 and the thickness of the dielectric member 2. As to the other conditions, the following observations have been obtained.

With increase of the dielectric constant of the dielectric member 2, the intermediate saturation starting voltage decreases, while the width of the intermediate saturation voltage range increases.

With increase of the operation temperature, the intermediate saturation starting voltage decreases, and the width of the intermediate saturation voltage region decreases.

With increase of the operation moisture, the intermediate saturation starting voltage increases, while the width of the intermediate saturation voltage decreases. However, the influence of the moisture and the ambient temperature can be made negligible by heating the surface of the dielectric member, particularly in the neighborhood of the discharging electrode.

As will be understood, all the conditions for producing the intermediate saturation voltage are not simply determined, but one ordinary skilled in the art is able to easily determine them in consideration of the foregoing description.

According to the present invention, an additional advantageous effect can be provided in addition to the reduction of the amount of the ozone production. This, resulting from the reduction of the discharge area, is the reduction of the discharge current between the surface of the dielectric member 2 and the discharging electrode 4, which leads to the reduction of the required energy down to approximately $\frac{1}{2}$–$\frac{1}{4}$.

Figure 11:
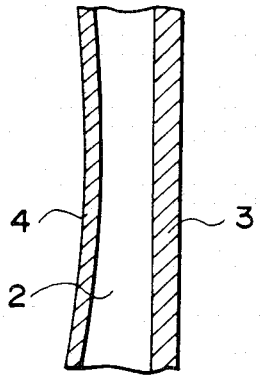
FIG. 11 is a sectional view of a conventional discharging device wherein the thickness of the dielectric member is not uniform.
Figure 12:
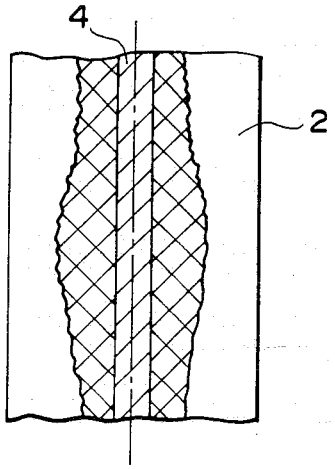
FIG. 12 is a plan view illustrating the discharge region when the discharge is produced under the condition shown in FIG. 9.
Figure 13:
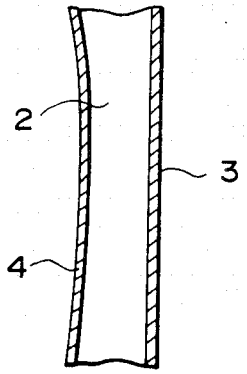
FIG. 13 is a sectional view of the discharging device according to an embodiment of the present invention wherein the thickness of the dielectric member is not uniform.
Figure 14:
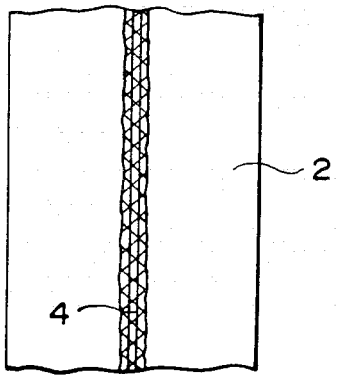
FIG. 14 is a plan view illustrating the discharge region when the discharging device shown in FIG. 11 is operated.

Further advantage has been confirmed. In the conventional devices, if the thickness of the dielectric member 2 is not uniform along the longitudinal direction, as shown in FIG. 11, the discharging electrode 4 is influenced by the non-uniformity with the result of the concentrated discharging on the small thickness portion. Therefore, the discharge region indicated in FIG. 12 by hatched lines becomes uniform, resulting in non-uniform discharge. This problem is significant, since the chargeable or dischargeable member 5 is non-uniformly charged or discharged. If the device is operated with the alternating voltage level at the intermediate saturation voltage according to the present invention, the discharge region does not vary as shown by hatched lines in FIG. 14, even if the thickness of the dielectric member 2 is non-uniform to a certain degree along the length of the dielectric member 2. Therefore, non-uniform charging or discharging results.

Figure 15:
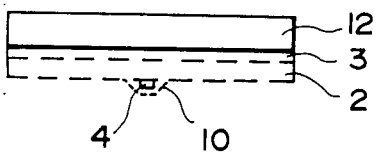
FIG. 15 is a sectional view of the discharging device illustrating a method of manufacturing it.

FIG. 15 illustrates an example of manufacturing the device embodying the charging or discharging method according to the present invention.

Firstly, as a base plate 12, a plate of insulating material such as glass, ceramic material and resin is prepared which has a thickness of 0.1–20 mm, preferably 0.2–10 mm. Onto one side (bottom side in this Figure) of the base plate 12, a layer of Cr, Ti, Ta, Ni, Au, Pt, Pl, Cu, or an alloy of two or more those materials is evaporated by sputtering technique or the like in a thickness of 0.1–10 microns, preferably 0.2–5 microns. The evaporated metal layer is formed into an inducing electrode 3 by known photolithographic and etching technique.

On the base plate 12 now having the dielectric electrode 3, a dielectric layer 2 is formed. The dielectric layer or member 2 has a thickness of 1.0 micron –1 mm, preferably 5–500 microns of inorganic dielectric material such as ceramic material ($Al_2O_3$, SiN, SiC or the like), glass (boro-silicate glass), mica or organic dielectric material such as polyimide, polyester, polytetrafluoroethylene, epoxy resin or composite material of them such as epoxy polymide film containing glass cloth. Such material is bonded or evaporated onto the base plate 12 having the dielectric electrode 3. Alternatively, the above described inducing electrode 3 is formed on the dielectric member, and then it is bonded to the base plate 12. In any case, this is the dielectric member 2 of the discharging device according to the present invention.

Subsequently, a thin layer of high fusing point metal is evaporated on the dielectric member 2, similarly to the inducing electrode 3. The layer has a thickness of 0.1–10 microns, preferably 0.2–5 microns and is made of, for example, Ti, W, Cr, Ta, Mo, Fe, Co, Ni, Nb, Au, Pt, an alloy including two or more of those materials or oxide of them. The layer is then formed into the discharging electrode 4 by known photolithographic and etching technique. In this manner, the discharging device which can carry out the method of the present invention, is produced.

According to this method of manufacturing, the discharging electrode 4 is formed by the evaporation and etching, so that there is no side edge produced, in the production of the dielectric member 2, and therefore, the edge portions of the electrode 4 can be made flat. This is desirable for the following reasons. In the case where the discharging electrode 4 is formed by printing, or where a metal plate is bonded to the dielectric member 2, and then etching is carried out, the edge portions are necessarily not smooth. The various experiments by the inventors have found that the unsmooth edge portions are a great cause of non-uniform discharging or charging. Conventionally, in order to solve this problem, alternating voltage applied between the inducing electrode 3 and the discharging electrode 4 is set sufficiently higher than the discharge on-set voltage, for example, when the dielectric member is of $Al_2O_3$ and has a thickness of 200 microns in which the on-set voltage is 2.3 KVpp, the applied alternating voltage is 2.7–3 KVpp, so as to relatively reduce the influence of the unsmoothness. This results in increasing the voltage beyond what is necessary, thus increasing the amount of the ozone production and loss of energy. According to the above described method of production of the discharging device, the layer which is going to be finally formed into the discharging electrode is formed by the evaporation or the like as a thin layer, and it is formed into the shape of the discharging electrode 4 by etching or the like, whereby smooth lateral ends can be formed. Therefore, the above described method of manufacturing the discharging device is particularly preferable when the charging or discharging method according to the present invention is embodied, since the method obviates the possible problem (the problem arising from the unsmooth surface of the lateral ends of the discharging electrode 4 which can be caused when the present invention is carried out wherein low voltage is used. After the discharging electrode is formed by the etching, the surface thereof may be plated by noble metal, and then the possible oxidization of the discharging electrode can be prevented.

As for the discharging device performing the method of the present invention, the exposed surface of the discharging electrode 4 can be uniformly coated by inorganic dielectric material such as a coating 10 of a metal oxide used for the dielectric member 2 as described above, nitride, silicon nitride, silicon dioxide, magnesium oxide, glass etc. The thickness of the coating is preferably 0.01–5 microns. The coating may be carried out by evaporation (usual evaporation, electron beam evaporation, sputtering evaporation, plasma polymerization, glow discharge polymerization, chemical vapor deposition or the like), plating, coating or oxidization treatment.

It has been confirmed that the above described advantageous effects of the present invention are not influenced, even when the coating is formed.

The coating is preferable in the present invention for the following reasons. As described hereinbefore, the small width of the discharging electrode 4 is preferable. Therefore, the electric resistance of the discharging electrode 4 is relatively large, with the result of the tendency that the voltage drop along the length of the discharging electrode 4 is larger. If this is significant, the charging or discharging effect is not uniform along the longitudinal direction. To avoid this, the material of the discharging electrode 4 is preferably Al, Cu, Ag or the like having very small specific resistance. However, those metals are relatively easily deteriorated by oxidation, since the discharging electrode 4 is directly exposed to ozone, electrons or various ions. When the above described coating is used, such a deterioration can be prevented, whereby a stabilized operation can be assured for a long period of time. Therefore, although the coating is not required to practice the present invention, it is particularly preferable in connection with the present invention.

As described above, according to the present invention, the ozone production can be reduced; discharging is not influenced by the non-uniform thickness of the dielectric member; and therefore, stabilized and uniform discharging operation can be continued. It follows that the chargeable member can be uniformly charged, or can be uniformly discharged.

While the invention has been described with reference to the structures disclosed herein, it is not confined to the details set forth and this application is intended to cover such modifcations or changes as may come within the purposes of the improvements or the scope of the following claims.

What is claimed is:

1. A method of charging or discharging a member, comprising:

providing a discharging device including a dielectric member and first and second electrodes sandwiching the dielectric member;

applying an alternating voltage between the first electrode and the second electrode to cause, adjacent to the second electrode, electrode discharge which is used to electrically charge or discharge the member;

wherein a relation between the alternating voltage and a distance from an end of the second electrode to an end of a region where the discharge occurs, is so determined that an intermediate saturation property is exhibited, and wherein the alternating voltage is within an intermediate saturation voltage of the intermediate saturation property.

2. A method according to claim 1, wherein the first electrode and the second electrode extend along a length of the dielectric member.

3. A method according to claim 2, wherein the second electrode has a width smaller than that of the first electrode.

4. A method according to claim 1, wherein the second electrode is formed by evaporating a thin metal layer on the dielectric member and is then etched.

5. A method according to claim 4, wherein the second electrode has a thickness of 0.1–5 microns.

6. A method according to claim 1, wherein said dielectric member is heated.

7. A method according to claim 1, wherein the second electrode has a surface coating by dielectric material.

8. A method according to any one of claims 1–7, wherein an electric field is formed between the second electrode and the member to be charged or discharged to extract, among ions produced by the discharge, the ions have a predetermined polarity.

9. A device for charging or discharging a member, comprising:

a dielectric member;

first and second electrodes sandwiching said dielectric member;

alternating voltage applying means for applying an alternating voltage between said first electrode and said second electrode to cause electric discharge adjacent said second electrode, the alternating voltage being in an intermediate saturation region in which an intermediate saturation property occurs which is exhibited in a relation between the alternating voltage and a distance of an end of a region where said discharge occurs from a lateral end of said second electrode.

10. A device according to claim 9, wherein the first electrode and the second electrode extend along a length of the dielectric member.

11. A device according to claim 10, wherein the second electrode has a width smaller than that of the first electrode.

12. A device according to claim 9, wherein the second electrode is formed by evaporating a thin metal layer on the dielectric member and is then etched.

13. A device according to claim 12, wherein the second electrode has a thickness of 0.1–5 microns.

14. A device according to claim 9, wherein said dielectric member is heated.

15. A device according to claim 9, wherein the second electrode has a surface coated by dielectric material.

16. A device according to any one of claims 9–15, wherein an electric field is formed between the second electrode and the member to be charged or discharged to extract, among ions produced by the discharge, the ions having a predetermined polarity.

* * * * *

UNITED STATES PATENT AND TRADEMARK OFFICE

CERTIFICATE OF CORRECTION

PATENT NO. : 4,700,261

DATED : October 13, 1988

INVENTOR(S) : YUKIO NAGASE, ET AL.

It is certified that error appears in the above-identified patent and that said Letters Patent is hereby corrected as shown below:

COLUMN 2

Line 18, "an" (second occurrence) should read --a--.

COLUMN 4

Line 6, "above described" should read --above-described--.

Line 20, "area v.s." should read --area vs.--.

Line 30, "monotonously" should read --generally linearly--.

Line 38, "feature" should read --features--.

COLUMN 5

Line 32, "scale v.s." should read --scale vs.--.

COLUMN 6

Line 32, "charged" should read --changed--.

Line 56, "volt" should read --volts,--.

Line 57, "practically" should read --the practical--.

COLUMN 7

Line 41, "ordinary" should read --ordinarily--.

COLUMN 8

Line 11, "more those" should read --more of those--.

UNITED STATES PATENT AND TRADEMARK OFFICE

CERTIFICATE OF CORRECTION

PATENT NO. : 4,700,261

DATED : October 13, 1988

INVENTOR(S) : YUKIO NAGASE, ET AL.

It is certified that error appears in the above-identified patent and that said Letters Patent is hereby corrected as shown below:

Line 27, "above described" should read --above-described--.

Line 56, "alternating" should read --the alternating--.

Line 66, "above described" should read --above-described--.

COLUMN 9

Line 4, "above described" should read --above-described--.

Line 10, "electrode 4" should read --electrode 4)--.

Line 28, "above described" should read --above-described--.

Line 43, "ozone, electrons" should read --ozone, oxygen, atoms, electrons--.

Line 44, "above described" should read --above-described--.

COLUMN 10

Line 3, "electrode discharge" should read --electric discharge--.

Line 26, "coating" should read --coated--.

Line 28, "claims 1-7" should read --claims 1 to 7--.

UNITED STATES PATENT AND TRADEMARK OFFICE

CERTIFICATE OF CORRECTION

PATENT NO. : 4,700,261

DATED : October 13, 1988

INVENTOR(S) : YUKIO NAGASE, ET AL.

It is certified that error appears in the above-identified patent and that said Letters Patent is hereby corrected as shown below:

COLUMN 10

Line 63, "claims 9-15" should read --claims 9 to 15,--.

Signed and Sealed this

Fifteenth Day of November, 1988

*Attest:*

DONALD J. QUIGG

*Attesting Officer*

*Commissioner of Patents and Trademarks*